US005736289A

United States Patent [19]

Sukata et al.

[11] Patent Number: 5,736,289

[45] Date of Patent: Apr. 7, 1998

[54] TONER FOR DEVELOPING ELECTROSTATIC IMAGES

[75] Inventors: Kazuaki Sukata, Kyoto; Shun-ichiro Yamanaka, Osaka, both of Japan

[73] Assignee: Orient Chemical Industries, Ltd., Osaka, Japan

[21] Appl. No.: 833,885

[22] Filed: Apr. 10, 1997

[30] Foreign Application Priority Data

Apr. 11, 1996 [JP] Japan ..... 8-115526

[51] Int. Cl.[6] ..... G03G 9/097

[52] U.S. Cl. ..... 430/110

[58] Field of Search ..... 430/110

[56] References Cited

U.S. PATENT DOCUMENTS

| | | | |
|---|---|---|---|
| 5,049,467 | 9/1991 | Yamanaka et al. | 430/110 |
| 5,318,883 | 6/1994 | Yamanaka et al. | 430/110 |
| 5,501,934 | 3/1996 | Sukata et al. | 430/110 |
| 5,510,222 | 4/1996 | Inaba et al. | 430/109 |
| 5,589,310 | 12/1996 | Uno et al. | 430/106 |
| 5,659,857 | 8/1997 | Yamazaki et al. | 430/109 |

FOREIGN PATENT DOCUMENTS

| | | |
|---|---|---|
| 385 580 | 9/1990 | European Pat. Off. . |
| 0 514 867 | 11/1992 | European Pat. Off. . |
| 0 649 065 | 4/1995 | European Pat. Off. . |
| 0 712 049 | 5/1996 | European Pat. Off. . |
| 63-138357 | 6/1988 | Japan . |
| 63-266462 | 11/1988 | Japan . |
| 2-201378 | 8/1990 | Japan . |
| 2-291569 | 12/1990 | Japan . |
| 07064336 | 3/1995 | Japan . |
| 07295299 | 11/1995 | Japan . |

OTHER PUBLICATIONS

C. David Gutsche et al., Dec. 15, 1980, Calixarenes. 4. The Synthesis Characterization, and Properties of the Calixarenes from p-tert-Butylphenol, J. Am. Chem. Soc. 1981, 103, 3782–3792.

*Primary Examiner*—Roland Martin

*Attorney, Agent, or Firm*—McGlew and Tuttle

[57] ABSTRACT

Toner for developing electrostatic images that comprises a binder resin, a coloring agent and a calixarene compound as a charge control agent, wherein some of the phenolic OH groups of said calixarene compound are metallized with alkali metal or alkaline earth metal.

13 Claims, No Drawings

TONER FOR DEVELOPING ELECTROSTATIC IMAGES

BACKGROUND OF THE INVENTION

1. Field of the Invention

The present invention relates to a toner for developing electrostatic images used to develop electrostatic latent images in electrophotography, electrostatic printing, etc., more specifically to a toner for developing electrostatic images that has good fixability and offset resistance.

2. Description of the Prior Art

In copying machines, printers and other instruments based on electrophotography, various toners containing a coloring agent, a fixing resin and other substances are used to visualize the electrostatic latent image formed on the photoreceptor having a light-sensitive layer containing an inorganic or organic photoconductive substance. These toners are required to show satisfactory performance as to chargeability, fixability, offset resistance, etc.

Chargeability is a key factor in electrostatic latent image—developing systems. Thus, to appropriately control toner chargeability, a charge control agent providing a positive or negative charge is often added to the toner. Of the conventional charge control agents in actual application, those providing a positive charge for a toner include nigrosine dyes and quaternary ammonium salt compounds. Charge control agents providing a negative charge include chromium complexes and iron complexes of azo dyes and metal complexes (metal salts) of alkylsalicylic acid and hydroxynaphthoic acid. However, dye type charge control agents lack versatility for use in color toners, although providing excellent chargeability. Quaternary ammonium salt type charge control agents generally lack environmental stability under high-temperature high-humidity conditions. Metal complexes or metal salts with an aromatic hydroxycarboxylic acid or the like as a ligand are inferior to dye type charge control agents in dispersibility in resin.

In recent years, to improve image quality while increasing copying and printing speeds, there has been increased demand regarding toner charge properties, such as increased rise speed, and toner fixing properties on recording paper, such as excellent low-temperature fixability and offset resistance.

However, not a few of such conventional charge control agents affect the thermal melting property of the binder resin in the toner, resulting in decreased fixing performance.

There are a number of known toners supplemented with various phenol compounds for the purpose of improving toner fixability and long-run property or preventing surface-treated carrier deterioration. For example, Japanese Patent unexamined Publication No. 138357/1988 discloses a toner containing an oligomer of a phenol compound having an alkyl-substituted amino group. Japanese unexamined Publication No. 291569/1990 discloses a toner incorporating a xanthene dye and a compound having a phenolic OH group. Japanese unexamined Publication No. 266462/1988 discloses toners respectively containing compounds such as 2,6-di-tertiary-butyl-4-ethylphenol and 2,2'-methylene-bis (4-methyl-6-tertiary-butylphenol). However, the developing agents incorporating these toners are unsatisfactory in charging properties.

SUMMARY OF THE INVENTION

The object of the present invention is to provide a toner for developing electrostatic images that contains a charge control agent excellent in charge control function, stability to changes in temperature and humidity, i.e., environmental resistance, and storage stability, versatile for use in color toners, including the three subtractive primaries yellow, magenta and cyan colors, good in heat resistance and binder resin compatibility, and capable of making the toner used to show excellent fixability and offset resistance, that has excellent charge property, environmental resistance and storage stability, that can be used as a toner with various chromatic or achromatic colors, and that has excellent fixability and offset resistance, at relatively low costs.

Some of the present inventors developed a charge control agent and toner that are based on a calix(n)arene compound and that are excellent in charge property, environmental resistance, storage stability, etc. (Japanese unexamined Publication No. 201378/1990).

This calixarene compound has a number of phenolic —OH groups in its molecular structure. The charge-providing property and charge stability of the compound are attributable to the phenolic —OH groups. However, the hydroxyl group as such was found to be problematic in that it interacts with the binder resin as the main ingredient of the toner and other components (e.g., releasing agent and coloring agent) to narrow the range of resin fixability.

To resolve this problem, the present inventors proposed a toner having a broad range of fixability, while retaining the chargeability obtained with the original calix(n)arene compound, by modifying some of the phenolic —OH groups in the calix(n)arene compound with an alkyl group, a benzyl group, or the like (Japanese Patent Application No. 302861/1994).

However, the approach to modifying some of the phenolic —OH groups in the calix(n)arene compound with an alkyl group or the like proved to have other aspects demanding further improvement, i.e., the yield rate in synthesis tends to be low, and the use of a large amount of alkylating agent results in increased production cost.

The present inventors found it possible to obtain a toner having a broad range of fixability, while preventing the adverse effect of toner interaction with binder resin etc. and retaining the essential thermal melting property of the binder resin, and to accomplish the above-described object, by incorporating as a charge control agent a compound that can be synthesized at relatively low costs and high yield by metallizing some of the phenolic —OH groups in a calix (n)arene compound with alkali metal or alkaline earth metal. The present inventors conducted further investigation based on this finding, and developed the present invention.

The toner of the present invention for developing electrostatic images contains a binder resin, a coloring agent and a calixarene compound as a charge control agent, wherein some of the phenolic OH groups in said calixarene compound are metallized with alkali metal or alkaline earth metal. It does not matter whether the term "some" refers to a large portion or a small portion.

The above-described calixarene compound in the toner of the present invention for developing electrostatic images may be a calix(n)arene compound represented by the following general formula [I]:

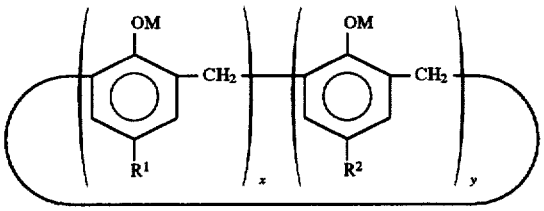

(I)

wherein x and y are each an integer of 1 or more, the sum of x and y is n, n is an integer of 3–8, and the x and y repeat units can be arranged in any order, $R^1$ and $R^2$ are each independently hydrogen; an alkyl group of 1–12 carbon atoms that is branched or unbranched; a substitutional alkyl group of 1–12 carbon atoms that is branched or unbranched; an aralkyl group of 7–12 carbon atoms; a phenyl group that has or does not have a substituent; an alicyclic group of 3–8 carbon atoms; halogen; a nitro group; an amino group; an alkyl- or phenyl-substituted amino group; —$Si(CH_3)_3$,; —$COOR^3$ ($R^3$ is hydrogen or a lower alkyl group); or —$SO_3L$ [L is hydrogen, alkali metal or alkaline earth metal (½)], of the n M members in the n —OM groups, 1 to (n–1) are hydrogens and the remaining (n–1) to 1 are alkali metal or alkaline earth metal (½).

The toner of the present invention for developing electrostatic images is excellent in charging properties, environmental resistance and storage stability, causes almost no color damage in the toner image even when used as various chromatic or achromatic toners, and excellent in fixability and offset resistance, especially in high-temperature offset resistance, and can be produced at relatively low costs.

DETAILED DESCRIPTION OF THE INVENTION

This calix(n)arene compound represented by general formula [I] is exemplified by:

1) those wherein $R^1$ and $R^2$ are the same, M in the —OM groups of x repeat units is hydrogen, and M in the —OM groups of y repeat units is alkali metal or alkaline earth metal (½), 2) those wherein $R^1$ and $R^2$ are different, M in the —OM groups of x repeat units is hydrogen, and M in the —OM groups of y repeat units is alkali metal or alkaline earth metal (½), 3) those wherein $R^1$ and $R^2$ are different, M in the —OM groups of x repeat units is hydrogen, M in (y–r) [r is an integer of 1–6] of the —OM groups of y [y is an integer of 2–7] repeat units is hydrogen, and M in r of the —OM groups of y repeat units is alkali metal or alkaline earth metal (½), 4) those wherein $R^1$ and $R^2$ are different, M in the —OM groups of x repeat units is alkali metal or alkaline earth metal (½), M in (y–r) [r is an integer of 1–6] of the —OM groups of y [y is an integer of 2–7] repeat units is hydrogen, and M in r of the —OM groups of y repeat units is alkali metal or alkaline earth metal (½), and 5) those wherein $R^1$ and $R^2$ are different, M in (x–t) [t is an integer of 1–5] of the —OM groups of x [x is an integer of 2–6] repeat units is a hydrogen, M in t of the —OM groups of x repeat units is alkali metal or alkaline earth metal (½), M in (y–r) [r is an integer of 1–5] of the —OM groups of y [y is an integer of 2–6] repeat units is hydrogen, and M in r of the —OM groups of y repeat units is alkali metal or alkaline earth metal (½).

The toner of the present invention for developing electrostatic images may contain one kind of the calix(n)arene compound represented by general formula [I], and may contain a number of kinds of the calix(n)arene compound.

Also, the calix(n)arene compound represented by general formula [I] above may contain two or more kinds of alkali metals or alkaline earth metals as M.

With respect to the calix(n)arene compound represented by general formula [I] above, $R^1$ and $R^2$ are exemplified by hydrogen; a non-substitutional alkyl group of 1–12 carbon atoms that is branched or unbranched, such as methyl, ethyl, propyl, isopropyl, n-butyl, tert-butyl, isoamyl, octyl, tert-octyl, 2-ethylhexyl and dodecyl; a substitutional alkyl group substituted by halogen or an alkoxy group (e.g., ethoxy, methoxy, propoxy, butoxy, isobutoxy), such as haloalkyl group (e.g., trifluoromethyl) and an alkoxyalkyl group (e.g., ethoxymethyl); an aralkyl group of 7–12 carbon atoms, such as benzyl, —$C(CH_3)_2$—$C_6H_5$ and —$CH_2CH_2$—$C_6H_5$; a phenyl and a substitutional phenyl group substituted by a lower alkyl group (1–3 carbon atoms) such as methyl and ethyl, or by halogen such as chlorine, bromine, iodine and fluorine; an alicyclic group of 4–8 carbon atoms, such as cyclohexyl, cycloheptyl and cyclooctyl; halogen such as chlorine, bromine, iodine and fluorine; a nitro group; an amino group; an amino group substituted by an alkyl (e.g., methyl, ethyl) or a phenyl; —$Si(CH_3)_3$; —$COOR^3$ [$R^3$ is hydrogen or a lower alkyl group (1 to 3 carbon atoms) such as methyl or ethyl]; and —$SO_3L$ [L is hydrogen, alkali metal (lithium, sodium, potassium, rubidium, cesium, etc.) or alkaline earth metal (½) (calcium, barium, etc.)].

Examples of M include alkali metals or alkaline earth metals capable of forming a metal salt with a phenolic —OH group in calixarene compounds, such as lithium, sodium, potassium, rubidium, cesium, calcium (½) and barium (½). Preferred are alkali metals such as lithium, sodium, potassium, rubidium and cesium.

Calixarene compounds have a cyclic structure similar to that of cyclodextrin, and can be obtained at good yield, for example, when prepared from the starting materials phenol and formaldehyde, especially in the presence of an alkali of high concentration.

Zinke et al. found that reacting phenol and formaldehyde in the presence of sodium hydroxide yields a high melting point substance (calixarene compound). Later, Gutsche et al. presented an extensive report on the production, structure and physical properties of various calixarene derivatives [J. Am. Chem. Soc., 103, 3782 (1981)].

PREPARATION EXAMPLE 1

For example, when a p-tertiary-butylcalix(n)arene compound is synthesized in accordance with an ordinary synthesis method (e.g., one-step synthesis), a mixture of a cyclic compound represented by formula [II] [n represents an integer of 3–8, and 1 to (n–1) of the n M members are hydrogen and, the remaining are alkali metal] and a non-cyclic compound represented by formula [III] [n represents an integer of 1–7, and 1 to (n+2) of the (n+3) M members are hydrogen and remaining are alkali metals] is produced. FDMS demonstrated that a cyclic compound wherein some of the —OH groups are alkali metallized can be separated by subsequently washing this mixture with the reaction solvent etc.

A cyclic compound wherein all —OH groups are intact can be purified and separated by such means as washing, extraction and recrystallization with acids, and washing with organic solvents.

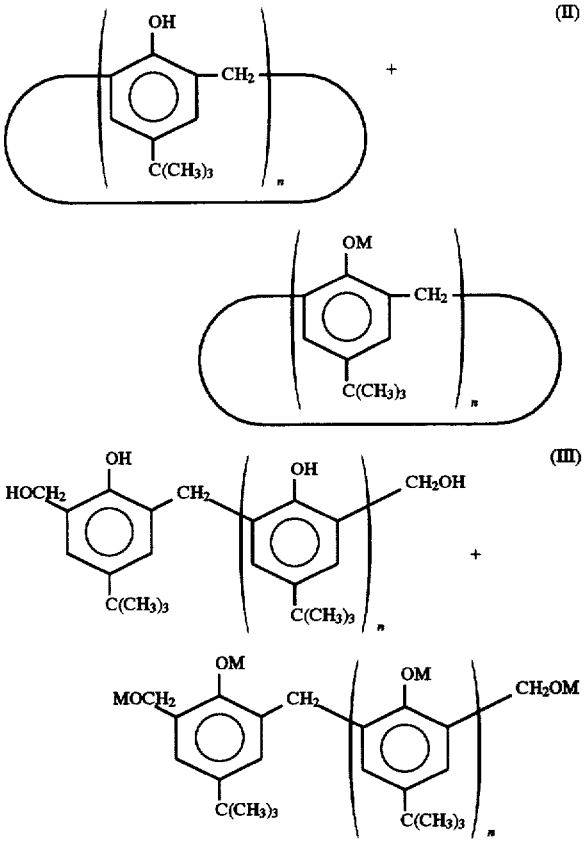

Also, with respect to the above- mentioned partially alkali metallized cyclic compound thus separated, the degree of metallization can be changed, or the alkali metal or alkaline earth metal contained therein can be replaced with another alkali metal or alkaline earth metal, by dispersing or dissolving it in an alcoholic solvent such as methanol or ethanol, a ketone solvent, or the like, adding the desired alkali metallizing agent or alkaline earth metallizing agent [e.g., NaOH, KOH, LiOH, RbOH, $Ca(OH)_2$, $Ba(OH)_2$] to the resulting dispersion liquid or solution, conducting the reaction at room temperature under refluxing conditions, then filtering the reaction mixture, washing and drying the filtration residue. These facts were confirmed by FDMS.

PREPARATION EXAMPLE 2

Of the calix(n)arene compounds of the present invention, those having different substituents can also be simply synthesized by the one-step method as in Preparation Example 1, by simultaneously charging two phenol derivatives having different substituents. FDMS, NMR and HPLC confirmed that the calix(n)arene compounds obtained by this method are mixtures of cyclic compounds wherein n is 3 to 8 and wherein the two phenol derivatives having different substituents are bound in any order. With respect to these compounds as well, the degree of metallization can be changed, or the alkali metal or alkaline earth metal contained therein can be replaced with another alkali metal or alkaline earth metal, by treating them in the same manner as in Preparation Example 1.

Example syntheses of calix(n)arene compounds containing a cyclic compound wherein some of the phenolic OH groups are alkali metallized [Synthesis Examples 1 through 9], examples of replacement of alkali metals or alkaline earth metals with other alkali metals or alkaline earth metals, or change of the degree of metallization, in the compounds obtained in accordance with Synthesis Examples 1 through 9 (one-step method) [Synthesis Examples 10 and 11], and examples of calix(n)arene compounds contained in the toner of the present invention as a charge control agent [Example Compounds 1 through 17] are given below. It should be noted, however, these examples are not to be construed as limitative on the calix(n)arene compounds in the present invention.

SYNTHESIS EXAMPLE 1

Using 135 g (0.9 mol) of p-tert-butylphenol, 45.5 g (1.2 mol) of paraformaldehyde and 1.5 g of 5N aqueous solution of potassium hydroxide, a refluxing reaction was carried out in 500 ml of xylene for 7 hours, while water was distilled off. The reaction mixture was allowed to cool at room temperature; the resulting precipitate was collected by filtration; the solid obtained was washed with xylene, after which it was dried under reduced pressure, to yield 123.9 g (yield 85.0%) of a white powder. This white powder was analyzed by H—NMR, mass analysis and HPLC, and identified as cyclic compound mainly containing p-tert-butylcalix(8)arene (some of the cyclic compounds were metallized with potassium).

SYNTHESIS EXAMPLE 2

Cyclic compounds mainly containing p-phenylcalix(8) arene (some of the cyclic compounds were metallized with potassium) was synthesized in the same manner as in Synthesis Example 1, except that p-tert-butylphenol was replaced with 153 g (0.9 mol) of p-phenylphenol.

SYNTHESIS EXAMPLE 3

Cyclic compound mainly containing p-cyclohexylcalix(8) arene (some of the cyclic compounds were metallized with potassium) was synthesized in the same manner as in Synthesis Example 1, except that p-tert-butylphenol was replaced with 157.5 g (0.9 mol) of p-cyclohexylphenol.

SYNTHESIS EXAMPLE 4

Cyclic compounds mainly containing p-benzylcalix(8) arene (some of the cyclic compounds were metallized with potassium) was synthesized in the same manner as in Synthesis Example 1, except that p-tert-butylphenol was replaced with 165.6 g (0.9 mol) of parabenzylphenol.

SYNTHESIS EXAMPLE 5

Using 75 g (0.5 mol) of p-tert-butylphenol, 103.2 g (0.5 mol) of p-tert-octylphenol, 45.5 g (1.2 mol) of paraformaldehyde and 1.0 g of 5N aqueous solution of potassium hydroxide, a refluxing reaction was carried out in 500 ml of xylene for 7 hours, while water was distilled off. The reaction mixture was allowed to cool at room temperature; the resulting precipitate was collected by filtration; the solid obtained was washed with xylene, after which it was dried under reduced pressure, to yield 102.5 g (yield 53.9%) of a white powder. This white powder was analyzed by H—NMR, mass analysis and HPLC, and identified as a mixture mainly containing calix(8)arene (some of the calix (8)arenes were metallized with potassium) wherein the two starting phenol derivatives were bound in any order.

SYNTHESIS EXAMPLE 6

Using 75 g (0.5 mol) of p-tert-butylphenol, 93.5 g (0.5 mol) of p-cyclohexylphenol, 45.5 g (1.2 mol) of paraformaldehyde and 1.0 g of 5N aqueous solution of sodium hydroxide, a refluxing reaction was carried out in 500 ml of xylene for 7 hours, while water was distilled off. The reaction mixture was allowed to cool at room temperature; the resulting precipitate was collected by filtration; the solid obtained was washed with xylene, after which it was dried under reduced pressure, to yield 102.4 g (yield rate 58.7%) of a white powder. This white powder was analyzed by H—NMR, mass analysis and HPLC, and identified as a mixture mainly containing calix(8)arene (some of the calix(8)arenes were metallized with sodium) wherein the two starting phenol derivatives were bound in any order.

SYNTHESIS EXAMPLE 7

Using 225 g (1.5 mol) of p-tert-butylphenol, 85 g (0.5 mol) of p-phenylphenol, 105 g (2.8 mol) of paraformaldehyde and 2.0 g of 5N aqueous solution of sodium hydroxide, stirring was carried out in 1,000 ml of xylene under heating conditions for 7 hours, followed by a refluxing reaction for 6 hours, while water was distilled off. The reaction mixture was allowed to cool at room temperature; the resulting precipitate was collected by filtration; the solid obtained was washed with xylene, after which it was dried under reduced pressure, to yield 220 g (yield 67.1%) of a white powder. This white powder was analyzed by H—NMR, mass analysis and HPLC, and identified as a mixture mainly containing calix(8)arene (some of the calix(8)arenes were metallized with sodium) wherein the two starting phenol derivatives were bound in any order.

SYNTHESIS EXAMPLE 8

Using 75 g (0.5 mol) of p-tert-butylphenol, 92 g (0.5 mol) of p-tolylphenol, 45.5 g (1.2 mol) of paraformaldehyde and 1.0 g of 10N aqueous solution of rubidium hydroxide, a refluxing reaction was carried out in 500 ml of xylene for 7 hours, while water was distilled off. The reaction mixture was allowed to cool at room temperature; the resulting precipitate was collected by filtration; the solid obtained was washed with xylene, after which it was dried under reduced pressure, to yield 107.4 g (yield 60%) of a white powder. This white powder was analyzed by H—NMR, mass analysis and HPLC, and identified as a mixture mainly containing calix(6)arene (some of the calix(6)arenes were metallized with rubidium) wherein the two starting phenol derivatives were bound in any order.

SYNTHESIS EXAMPLE 9

A mixture mainly containing calix(8)arene was obtained in the same manner as in Synthesis Example 5, except that the mixing ratio of p-tert-butylphenol (0.5 mol) and p-tert-octylphenol (0.5 mol) was changed to 60 g (0.4 mol) of p-tert-butylphenol and 123.8 g (0.6 mol) of p-tert-octylphenol.

The phenolic OH groups in the calix(n)arene compounds which can be obtained by the above-described Synthesis Examples or similar methods can be partially alkali or alkaline earth metallized by dispersing the calix(n)arene compound or a mixture thereof in an alcoholic solvent such as methanol or ethanol, or the like, adding the desired alkali metallizing agent or alkaline earth metallizing agent [e.g., NaOH, KOH, LiOH, RbOH, $Ca(OH)_2$, $Ba(OH)_2$] to the dispersion liquid, and stirring the mixture at normal temperature under refluxing conditions for at least 1 hour, preferably 2 to 5 hours. Specifically, the following Synthesis Examples 10 and 11 may be mentioned.

SYNTHESIS EXAMPLE 10

After 13.0 g (0.01 mol) of the p-tert-butylcalix(8)arene obtained in Synthesis Example 1 was dispersed in 150 ml of methanol, 2.2 g (0.04 mol) of potassium hydroxide was added, followed by stirring under refluxing conditions for 2 hours. The reaction mixture was allowed to cool at room temperature, after which it was filtered under reduced pressure; the resulting filtration residue was washed with water and dried to yield 12.4 g (yield 94.1%) of a pale yellowish white powder mainly containing Example Compound 1.

SYNTHESIS EXAMPLE 11

After 14.6 g (0.01 mol) of the p-phenylcalix(8)arene obtained in Synthesis Example 2 was dispersed in 150 ml of ethanol, 23.9 g (0.08 mol) of lithium hydroxide was added, followed by stirring under refluxing conditions for 4 hours. The reaction mixture was allowed to cool at room temperature, after which it was filtered under reduced pressure; the resulting filtration residue was washed with water and dried to yield 13.9 g (yield 94.7%) of a light-greenish white powder mainly containing Example Compound 8.

The example compounds obtained by the above-described example syntheses and other example compounds synthesized by similar methods are given below. With respect to the example compounds shown below, units in parentheses are arranged circularly in any optional order. In the following example compounds, tert-Bu and tert-Oct are tert-butyl and tert-octyl respectively.

EXAMPLE COMPOUND 1

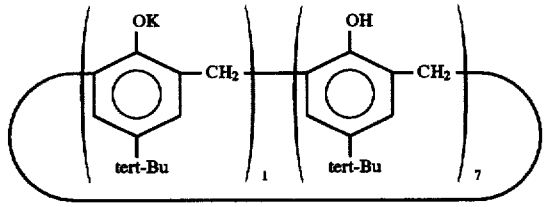

EXAMPLE COMPOUND 2

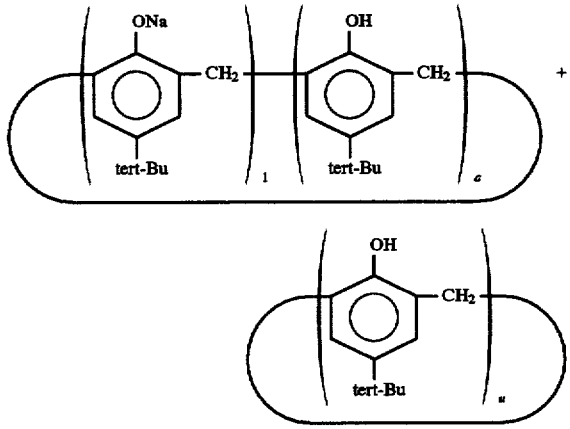

(Example Compound 2 is a mixture of a number of compounds wherein "a" is an integer of 5–7 and a number of compounds wherein "u" is an integer of 6–8.)

EXAMPLE COMPOUND 3

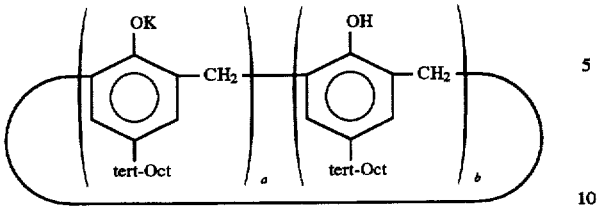

(Example Compound 3 is a mixture of a number of compounds wherein "a" is 1 or 2 and "b" is an integer of 2–6.)

EXAMPLE COMPOUND 4

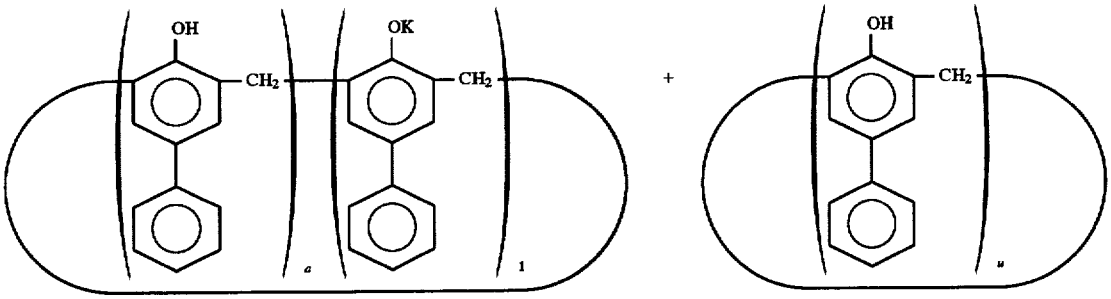

(Example Compound 4 is a mixture of a number of compounds wherein "a" is an integer of 3–7 and a number of compounds wherein "u" is an integer of 4–8.)

EXAMPLE COMPOUND 5

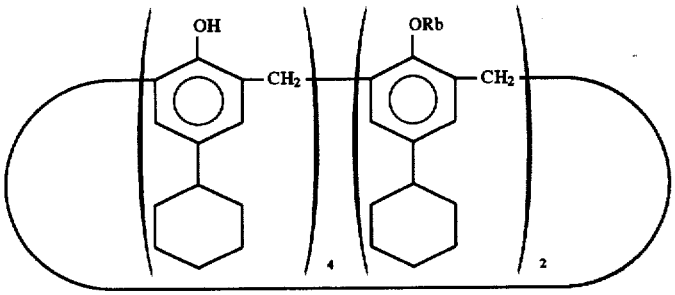

EXAMPLE COMPOUND 6

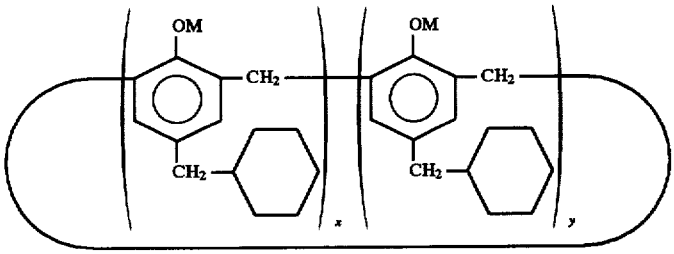

(Example Compound 6 is a mixture of a number of compounds wherein M is H or Na, each of x and y is an integer of 1 or more, and the sum of x and y is 4 to 8.)

EXAMPLE COMPOUND 7
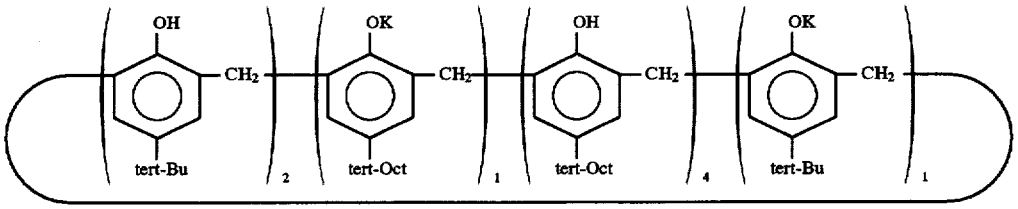
EXAMPLE COMPOUND 8
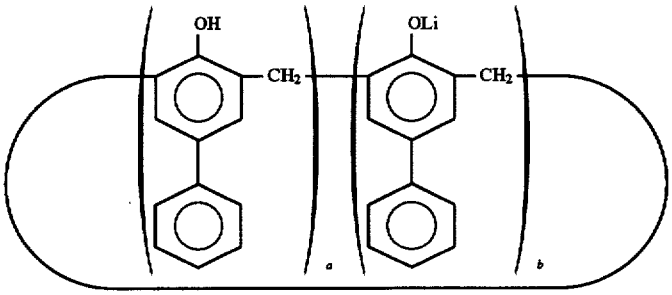
(Example Compound 8 is a mixture of a number of compounds wherein "a" is an integer of 3–6 and "b" is an integer of 0–2.)
EXAMPLE COMPOUND 9
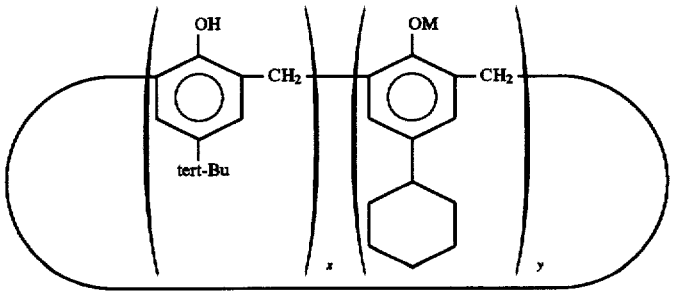
(Example Compound 9 is a mixture of a number of compounds wherein M is H or Na, each of x and y is an integer of 1 or more, and the sum of x and y is 3 to 6.)

EXAMPLE COMPOUND 10
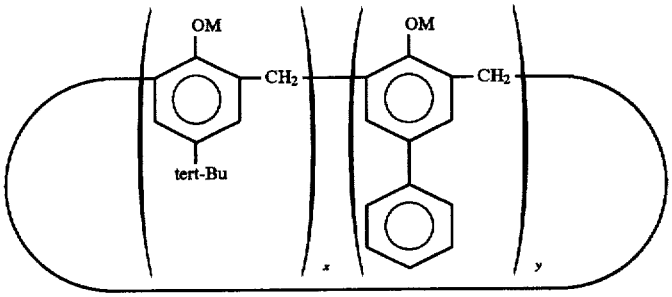
(Example Compound 10 is a mixture of a number of compounds wherein M is H or K, each of x and y is an integer of 1 or more, and the sum of x and y is 3 to 8.)
EXAMPLE COMPOUND 11
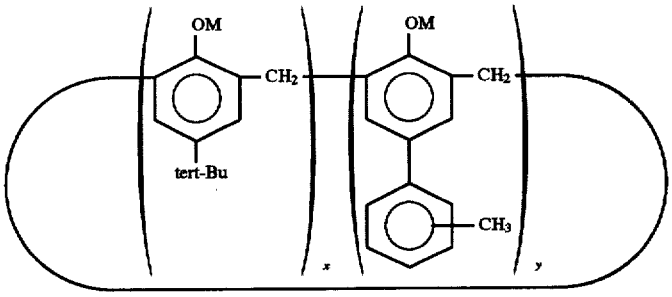
(Example Compound 11 is a mixture of a number of compounds wherein M is H or Rb, each of x and y is an integer of 1 or more, and the sum of x and y is 3 to 8.)
EXAMPLE COMPOUND 12
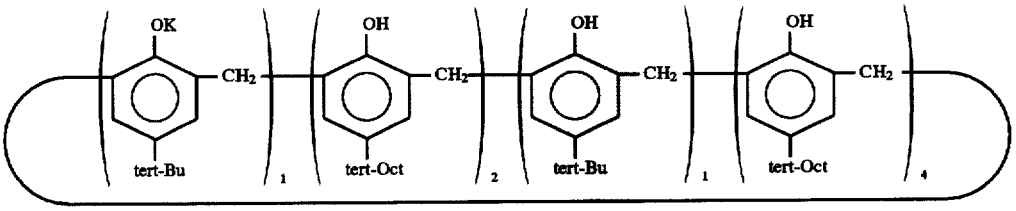
EXAMPLE COMPOUND 13
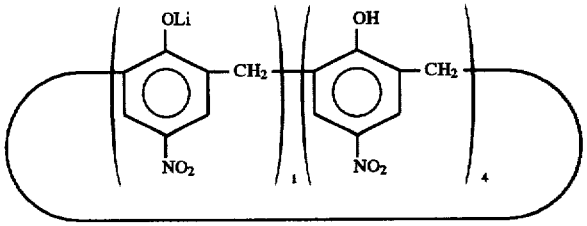
EXAMPLE COMPOUND 14
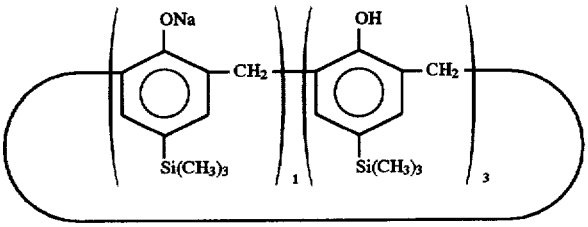

EXAMPLE COMPOUND 15

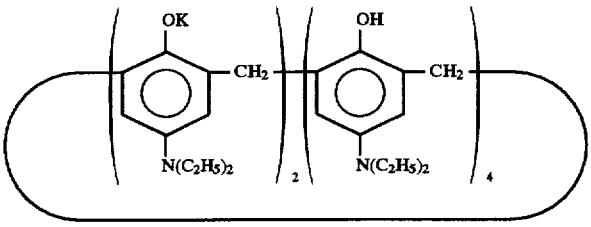

EXAMPLE COMPOUND 16

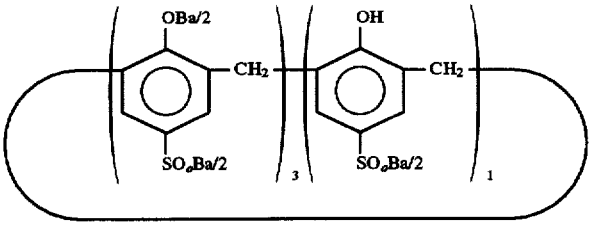

EXAMPLE COMPOUND 17

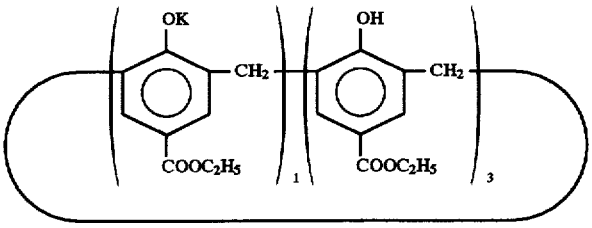

The toner of the present invention for developing electrostatic images may contain one kind of the above-described calixarene compound wherein some of the phenolic OH groups are alkali or alkaline earth metallized [including the calix(n)arene compound represented by general formula [I]], and may contain a number of kinds thereof as a mixture. The toner of the present invention may also contain the original calix(n)arene compound (including calix(n)arenes wherein all —OM groups in general formula [I] are —OH groups], as long as the object of the present invention is accomplished.

It is desirable that the toner of the present invention for developing electrostatic images contain the calix(n)arene compound of the present invention as a charge control agent in a ratio of 0.1 to 10 parts by weight per 100 parts by weight of binder resin. More preferably, the content ratio is 0.5 to 5 parts by weight per 100 parts by weight of binder resin.

To improve toner quality, additives such as electroconductive grains, fluidity-improving agents, releasing agents and image peeling-preventing agents may be added internally or externally.

Examples of resins used in the toner of the present invention include the following known binder resins for use in toners. Specifically, styrene resin, styrene-acrylic resin, styrene-butadiene resin, styrene-maleic acid resin, styrene-vinyl methyl ether resin, styrene-methacrylic acid ester copolymer, phenol resin, epoxy resin, polyester resin, polypropylene resin, paraffin wax, etc. may be used singly or in blends.

For preferable use of a binder resin for toners in a toner for full-color imaging by subtractive mixing or for OHP (overhead projectors) etc., the binder resin is required to be transparent, substantially colorless (no tone damage occurs in the toner image) and compatible with the charge control agent of the present invention.

Also, the binder resin is required to have desired thermal melting property, elasticity, fluidity and other properties, so as to meet the requirements regarding toner fixability to paper upon melting, toner offset resistance for heat roller, and toner blocking resistance during storage. Examples of preferable resins capable of meeting these requirements include acrylic resin, styrene-acrylic resin, styrene-methacrylic acid ester copolymer and polyester resin.

The toner of the present invention may incorporate various known dyes and pigments as coloring agents, which may be used singly or in combination.

Examples of pigments include organic pigments such as quinophthalone yellow, hansa yellow, isoindolinone yellow, perinone orange, perirene maroon, rhodamine 6G lake, quinacridone, anthanthrone red, rose bengale, copper phthalocyanine blue, copper phthalocyanine green and diketopyrrolopyrrole pigments; and inorganic pigments such as carbon black, titanium white, titanium yellow, ultramarine, cobalt blue and red iron oxide.

Examples of preferable coloring agents for use in color toners include various oil-soluble dyes and dispersion dyes such as azo dyes, quinophthalone dyes, anthraquinone dyes, phthalocyanine dyes, indophenol dyes and indoaniline dyes; and xanthene and triarylmethane dyes modified with resins such as rosin, rosin-modified phenol and maleic acid.

Dyes and pigments having a good spectral property can be preferably used to prepare a toner of the three primaries for full-color imaging. Chromatic monocolor toners may incorporate an appropriate combination of a pigment and dye of the same color tone (e.g., quinophthalone pigment and dye, xanthene or rhodamine pigment and dye, phthalocyanine pigment and dye).

The toner of the present invention for developing electrostatic images is, for example, produced as follows:

A dry negatively chargeable toner having an average particle diameter of 5 to 20 μm can be obtained by thoroughly mixing a binder resin and coloring agent as described above, the above-described calixarene compound wherein some of the phenolic OH groups are alkali or alkaline earth metallized [including the calix(n)arene compound represented by general formula [I]] as a charge control agent, and, if necessary, a magnetic material, a fluidizing agent and other additives, using a ball mill or another mechanical mixer, subsequently kneading the mixture in a molten state using a hot kneader such as a heat roll, kneader or extruder, cooling and solidifying the mixture, then pulverizing the solid and classifying the resulting particles by size.

Other usable methods include the method in which starting materials, such as a coloring agent and the above-described charge control agent, are dispersed in a binder resin solution, and subsequently spray dried, and the polymerizing toner production method in which a given set of starting materials are mixed in a monomer for binder resin to yield an emulsified suspension, which is then polymerized to yield the desired toner.

When the toner of the present invention is used as a two-component developer, development can be achieved by the two-component magnetic brush developing process, etc. using the toner in mixture with carrier powder.

Any known carrier can be used. Examples of the carrier include iron powder, nickel powder, ferrite powder and glass beads about 50 to 200 μm in particle diameter, and such materials as coated with acrylic acid ester copolymer, styrene-acryic acid ester copolymer, styrene-methacrylic acid ester copolymer, silicone resin, polyamide resin, ethylene fluoride resin or the like.

When the toner of the present invention is used as a one-component developer, fine powder of a ferromagnetic material such as iron powder, nickel powder or ferrite powder may be added and dispersed in preparing the toner as described above. Examples of developing processes which can be used in this case include contact development and jumping development.

EXAMPLES

The present invention is hereinafter described in more detail by means of the following examples, which are not to be construed as limitative. In the description below, "part(s) by weight" are referred to as "part(s)" for short.

Example 1

Styrene-acrylic copolymer resin [HIMER SMB600 (trade name), produced by Sanyo Kasei Co., Ltd.]. . . 100 parts Low polymer polypropylene [Biscal 550P (trade name), produced by Sanyo Kasei Co., Ltd.]. . . 3 parts Carbon black [MA-100 (trade name), produced by Mitsubishi Chemical Industries, Ltd.]. . . 7 parts Charge control agent (Example Compound 1) . . . 1 part The above ingredients were uniformly pre-mixed using a high-speed mixer. The mixture was then kneaded in a molten state using a heat roll and cooled, after which it was roughly milled in a vibration mill. The coarse product obtained was finely pulverized using an air jet mill equipped with a classifier to yield a negatively chargeable black toner 5 to 15 μm in particle diameter.

Five parts of this toner was admixed with 95 parts of an iron powder carrier [TEFV 200/300 (trade name), produced by Powdertech Co., Ltd.) to yield a developer; initial chargeability and fixability were determined. The results are shown in Table 1.

When this developer was used for repeated cycles of actual imaging, high-quality black images free of density reduction and fogging were obtained, with good charge stability (narrow variation in amount of charges) and sustainability.

Initial chargeability: The amount of initial blowoff charges of the developer was determined under standard conditions (25° air temperature, 50% relative humidity), low-temperature low-humidity conditions (5° C. air temperature, 30% relative humidity) and high-temperature high-humidity conditions (35° C. air temperature, 90% relative humidity). The same applies to the working examples and comparative examples shown below.

Fixability: An actual imaging experiment was conducted in which the developer, set on a commercial electrophotographic copying machine having a modified fixing portion, was used at a low (120° C.) or high (200° C.) heat roller fixing temperature to assess the fixability and offset resistance. The results are shown in Table 1. In Table 1, ○, Δ and x indicate ratings "good", "fair" and "poor", respectively.

Example 2

A toner of the present invention and developer were prepared in the same manner as in Example 1, except that the charge control agent used in Example 1 was replaced with Example Compound 7; initial chargeability was determined, and fixability and offset resistance were assessed. The results are shown in Table 1.

Example 3

Styrene-acrylic copolymer resin [HIMER SMB600 (trade name), produced by Sanyo Kasei Co., Ltd.]. . . 100 parts Low polymer polypropylene [Biscal 550P (trade name), produced by Sanyo Kasei Co., Ltd.]. . . 3 parts Copper phthalocyanine dye [Valifast Blue 2606 (trade name), produced by Orient Chemical Industries Ltd.]. . . 2 parts Copper phthalocyanine pigment . . . 3 parts Charge control agent (Example Compound 4) . . . 1 part The above ingredients were treated in the same manner as in Example 1 to yield a negatively chargeable toner, which was then used to prepare a developer. Initial chargeability was determined, and fixability and offset resistance were assessed. The results are shown in Table 1.

When this developer was used for repeated cycles of actual imaging, high-quality cyan images free of density reduction and fogging were obtained, with good charge stability and sustainability.

Example 4

A toner and developer according to the present invention were prepared in the same manner as in Example 3, except that the charge control agent used in Example 3 was replaced with Example Compound 8; initial chargeability was determined, and fixability and offset resistance were assessed. The results are shown in Table 1.

Example 5

Polyester resin [HP-301 (trade name), produced by The Nippon Synthetic Chemical Industry, Co., Ltd.]. . . 100 parts Low polymer polypropylene [Biscal 550P (trade name), produced by Sanyo Kasei Co., Ltd.]. . . 3 parts Rhodamine dye [Oil Pink #312 (trade name), produced by Orient Chemical Industries Ltd.]. . . 7 parts Quinacridone red . . . 3 parts Charge control agent (Example Compound 2) . . . 1.5 parts The above ingredients were treated in the same manner as in Example 1 to yield a negatively chargeable toner, which was then used to prepare a developer. Initial chargeability was determined, and fixability and offset resistance were assessed. The results are shown in Table 1.

When this developer was used for repeated cycles of actual imaging, high-quality magenta images free of density reduction and fogging were obtained, with good charge stability and sustainability.

Example 6

A toner and developer according to the present invention were prepared in the same manner as in Example 5, except that the charge control agent used in Example 5 was replaced with Example Compound 5; initial chargeability was determined, and fixability and offset resistance were assessed. The results are shown in Table 1.

Example 7

Styrene-acrylic copolymer resin [HIMER SMB600 (trade name), produced by Sanyo Kasei Co., Ltd.]. . . 100 parts Low polymer polypropylene [Biscal 550P (trade name), produced by Sanyo Kasei Co., Ltd.]. . . 3 parts Hydroxyquinophthalone dye [C.I. Disperse Yellow 64] . . . 3 parts Charge control agent (Example Compound 3) . . . 2 parts The above ingredients were treated in the same manner as in Example 1 to yield a negatively chargeable toner, which was then used to prepare a developer. Initial chargeability was determined, and fixability and offset resistance were assessed. The results are shown in Table 1.

When this developer was used for repeated cycles of actual imaging, high-quality yellow images free of density reduction and fogging were obtained, with good charge stability and sustainability.

Example 8

A toner and developer according to the present invention were prepared in the same manner as in Example 7, except that the charge control agent used in Example 7 was replaced with Example Compound 6. Initial chargeability was determined, and fixability and offset resistance were assessed. The results are shown in Table 1.

Example 9

Styrene-2-ethylhexyl methacrylate copolymer resin (80/20) . . . 100 parts

Tri-iron tetroxide [EPT-500 (trade name), produced by Toda Kogyo Corporation]. . . 40 parts Low polymer polypropylene [Biscal 550P (trade name), produced by Sanyo Kasei Co., Ltd.]. . . 4 parts Carbon black [MA-100, produced by Mitsubishi Chemical Industries, Ltd.]. . . 6 parts Charge control agent (Example Compound 12) . . . 2 parts The above ingredients were uniformly pre-mixed using a ball mill to yield a premix, which was then kneaded in a molten state at 180° C. using a heat roll, cooled and thereafter roughly milled, finely pulverized and classified by size to yield a one-component toner having a particle diameter range from 5 to 15 μm.

When this toner was used for a commercial copying machine to form toner images, fog-free high-quality images with good thin-line reproducibility were obtained. Also, the fixability was good, and the offset phenomenon was not observed.

Comparative Example 1

To compare initial chargeability, fixability and offset resistance, a black toner was prepared in the same manner as in Example 1, except that Example Compound 1, used as a charge control agent in Example 1, was replaced with the p-tert-butylcalixarene compound (A) shown below (mixture of a number of compounds wherein "u" is an integer of 6–8); initial chargeability was determined, and fixability and offset resistance were assessed. The results are shown in Table 1.

Although no marked difference was noted in terms of initial chargeability, the developer was unsatisfactory in terms of fixability in the high-temperature range.

(A)

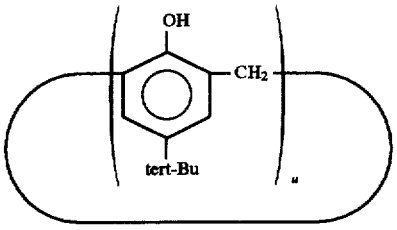

Comparative Example 2

A comparative blue toner was prepared in the same manner as in Example 1, except that Example Compound 4, used in Example 3, was replaced with a p-phenylcalixarene compound (B) (mixture of a number of compounds wherein "u" is an integer of 4–8); initial chargeability was determined, and fixability and offset resistance were assessed. The results are shown in Table 1.

(B)

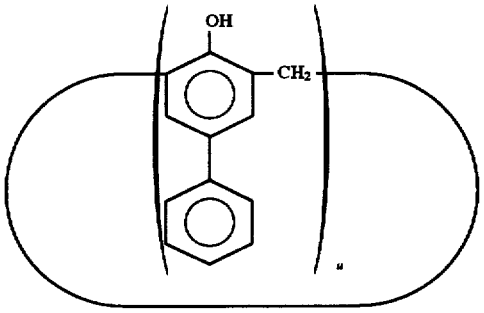

Comparative Example 3

A comparative red toner was prepared in the same manner as in Example 5, except that Example Compound 2, used as a charge control agent in Example 5, was not used; initial chargeability was determined, and fixability and offset resistance were assessed. The results are shown in Table 1. This comparative toner was evaluated as unacceptable because the images formed therewith showed image sputtering, blurs, fogging, etc. The results are shown in Table 1.

TABLE 1

| | Initial chargeability (μC/g) | | | Fixability | | | |
|---|---|---|---|---|---|---|---|
| | Standard conditions | High-temperature high-humidity conditions | Low-temperature low-humidity conditions | Low-temperature condition | High-temperature conditions | Offset resistance | Charge control agent (Example Compound) |
| Example 1 | −20.0 | −19.9 | −20.4 | O | O | O | 1 |
| Example 2 | −21.3 | −21.0 | −21.4 | O | O | O | 7 |
| Example 3 | −18.9 | −18.8 | −19.3 | O | O | O | 4 |
| Example 4 | −19.8 | −19.4 | −20.0 | O | O | O | 8 |
| Example 5 | −22.1 | −21.7 | −22.0 | O | O | O | 2 |

TABLE 1-continued

| | Initial chargeability (μC/g) | | | Fixability | | | Charge control |
|---|---|---|---|---|---|---|---|
| | Standard conditions | High-temperature high-humidity conditions | Low-temperature low-humidity conditions | Low-temperature condition | High-temperature conditions | Offset resistance | agent (Example Compound) |
| Example 6 | −18.7 | −18.2 | −18.8 | O | O | O | 5 |
| Example 7 | −19.9 | −19.8 | −20.2 | O | O | O | 3 |
| Example 8 | −20.1 | −20.0 | −20.4 | O | O | O | 6 |
| Example 9 | — | — | — | O | O | O | 12 |
| Comparative Example 1 | −20.9 | −20.2 | −20.3 | O | Δ | O or Δ | A |
| Comparative Example 2 | 18.6 | −18.4 | −18.5 | O | Δ | O or Δ | B |
| Comparative Example 3 | −4.2 | −4.0 | −3.9 | — | — | X | — |

What is claimed is:

1. A toner for developing electrostatic images that comprises a binder resin, a coloring agent and a calixarene compound as a charge control agent, wherein some of the phenolic OH groups of said calixarene compound are metallized with alkali metal or alkaline earth metal.

2. Toner of claim 1 for developing electrostatic images wherein said calixarene compound is a calix(n)arene compound represented by the following general formula [I]:

[I]

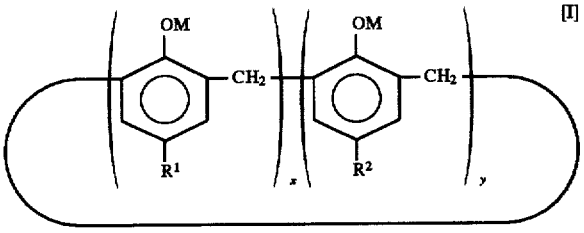

wherein x and y are each an integer of 1 or more, the sum of x and y is n, n is an integer of 3–8, and the x and y repeat units can be arranged in any order, $R^1$ and $R^2$ are each independently hydrogen; an alkyl group of 1–12 carbon atoms that is branched or unbranched; a substitutional alkyl group of 1–12 carbon atoms that is branched or unbranched; an aralkyl group of 7–12 carbon atoms; a phenyl group that has or does not have a substituent; an alicyclic group of 4–8 carbon atoms; halogen; a nitro group; an amino group; an alkyl- or phenyl-substituted amino group; —Si $(CH_3)_3$,; —$COOR^3$ ($R^3$ is hydrogen or a lower alkyl group); or —$SO_3L$ [L is hydrogen, alkali metal or alkaline earth metal (½)], of the n M members in the —OM groups, 1 to (n−1) M are hydrogens and the remaining (n−1) to 1M are alkali metal or alkaline earth metal (½).

3. Toner of claim 2 wherein $R^1$ and $R^2$ are the same, M in the x repeat units is hydrogen, and M in the y repeat units is alkali metal or alkaline earth metal (½).

4. Toner of claim 2 wherein $R^1$ and $R^2$ are different, M in the x repeat units is hydrogen and M in the y repeat units is alkali metal or alkaline earth metal (½).

5. Toner of claim 2 wherein $R^1$ and $R^2$ are different, M in the x repeat units is hydrogen, M in (y−r) of the y repeat units is hydrogen, M in r of the y repeat units is alkali metal or alkaline earth metal (½) and r is an integer of 1–6.

6. Toner of claim 2 wherein $R^1$ and $R^2$ are different, M in the x repeat units is alkali metal or alkaline earth metal (½), M in (y−r) of the y repeat units is hydrogen, M in r of the y repeat units is alkali metal or alkaline earth metal (½) and r is an integer of 1–6.

7. Toner of claim 2 wherein $R^1$ and $R^2$ are different, M in (x−t) of the x repeat units is a hydrogen, M in t of the x repeat units is alkali metal or alkaline earth metal (½), M in (y−r) of the y repeat units is hydrogen, M in r of the y repeat units is alkali metal or alkaline earth metal (½) and t and r are each an integer of 1–5.

8. Toner of claim 1 wherein some of the phenolic OH groups are metallized with alkali metal.

9. Toner of claim 2 wherein the remaining (n−1) to 1M are alkali metal.

10. Toner of claim 2 wherein the charge control agent comprisrs a mixture of two or more calix(n)arene compounds having different x and y numbers.

11. Toner of claim 2 wherein the charge control agent comprisrs a mixture of two or more calix(n)arene compounds having different x and y numbers of —OH as —OM groups.

12. Toner of claim 2 wherein the charge control agent comprises a mixture of two or more calix(n)arene compounds having different x and y numbers and different numbers of —OH as —OM groups.

13. Toner of claim 1 which contains the calix(n)arene compound as a charge control agent in a ratio of 0.1 to 10 parts by weight per 100 parts by weight of binder resin.

* * * * *